US006244456B1

(12) United States Patent
Hanlon

(10) Patent No.: US 6,244,456 B1
(45) Date of Patent: Jun. 12, 2001

(54) IDENTIFIABLE BEVERAGE CONTAINER

(76) Inventor: Dennis J. Hanlon, 15 Morris Rd., East Haven, CT (US) 06512

( * ) Notice: Subject to any disclaimer, the term of this patent is extended or adjusted under 35 U.S.C. 154(b) by 0 days.

(21) Appl. No.: 09/252,119

(22) Filed: Feb. 17, 1999

(51) Int. Cl.[7] ..... B65D 17/34

(52) U.S. Cl. ..... 220/269; 220/906; 215/230; 116/307

(58) Field of Search ..... 220/269, 212, 220/906; 116/367; 286/459; 215/230

(56) References Cited

U.S. PATENT DOCUMENTS

| | | | |
|---|---|---|---|
| Re. 33,979 | 6/1861 | Cortopassi . | |
| D. 246,955 | 1/1978 | Davis . | |
| D. 259,403 | 6/1981 | Frazier, Jr. . | |
| 3,930,592 | 1/1976 | Diianni . | |
| 3,941,277 | 3/1976 | McKinney et al. . | |
| 3,958,354 | 5/1976 | Hough et al. . | |
| 3,974,916 | 8/1976 | Bartolucci . | |
| 4,184,607 | 1/1980 | Potts . | |
| 4,227,613 | 10/1980 | Seitz . | |
| 4,325,230 | 4/1982 | Driscoll et al. . | |
| 4,363,419 | 12/1982 | Walz, Sr. . | |
| 4,465,204 | 8/1984 | Kaminski et al. . | |
| 4,630,733 | 12/1986 | Fear . | |
| 4,750,668 | 6/1988 | Behne et al. . | |
| 4,951,835 | 8/1990 | Demars et al. . | |
| 5,064,087 | 11/1991 | Koche . | |
| 5,131,555 | 7/1992 | Demars et al. . | |
| 5,358,770 | 10/1994 | Evans . | |
| 5,385,254 | 1/1995 | Hannon . | |
| 5,386,795 | 2/1995 | Bartholomew . | |
| 5,388,697 | 2/1995 | James . | |
| 5,411,159 | 5/1995 | Fan . | |
| 5,421,286 | 6/1995 | McLean . | |
| 5,456,378 | 10/1995 | Demars . | |
| 5,492,077 | 2/1996 | Rose . | |
| 5,529,179 | 6/1996 | Hanson . | |
| 5,704,144 | 1/1998 | Groth . | |
| 5,715,964 | 2/1998 | Turner et al. . | |
| 5,799,815 | 9/1998 | Lang . | |
| 6,053,349 * | 4/2000 | Griggs, Jr. et al. | 220/269 |

* cited by examiner

*Primary Examiner*—Stephen K. Cronin
(74) *Attorney, Agent, or Firm*—Bachman & LaPointe, P.C.

(57) ABSTRACT

An identification system for a beverage container includes a beverage container; and a plurality of discrete areas associated with the container, each area being configurable from an original condition to a visibly different condition.

7 Claims, 4 Drawing Sheets

IDENTIFIABLE BEVERAGE CONTAINER

CROSS REFERENCE TO DISCLOSURE DOCUMENT

This Patent Application is based on disclosure document number 444002 filed Aug. 31, 1998.

BACKGROUND OF THE INVENTION

The invention relates to an identification system for a beverage container.

Social gatherings frequently result in groups of people being served the same types of beverages. At informal gatherings and the like, these beverages may frequently be served in the beverage container or can in which the beverage is purchased. This frequently leads to problems in identifying which beverage container belongs to a particular person.

One attempt to provide a solution for this problem is disclosed in U.S. Pat. No. 5,492,077 to Rose. Rose '077discloses an indicating pop top beverage container which has indicia positioned around the top of the container so that the pull tab can be pivoted to point at a particular indicia for identification purposes. Although this may provide a partial solution to the problem, the tab can only be positioned to a small number of different positions, specifically five positions as shown in Rose '077, and some of these positions involve the pull tab being positioned at least partially over the can opening where it may interfere with consuming beverage from the container.

U.S. Pat. Nos. 5,358,770 to Evans, U.S. Pat. No. 5,704,144 to Groth and U.S. Pat. No. 5,799,815 to Lang indicate additional efforts to resolve the aforesaid problem.

The need remains for a simple, reliable and cost effective method for identifying beverage containers.

It is therefore the primary object of the present invention to provide a simple, versatile and reliable system for identifying beverage containers.

It is a further object of the present invention to provide an identification system which can be readily adapted for use in connection with any beverage container.

It is a still further object of the present invention to provide a system which can be configured to represent a large number of different identifications.

Other objects and advantages of the present invention will appear hereinbelow.

SUMMARY OF THE INVENTION

In accordance with the present invention, the foregoing objects and advantages have been readily attained.

According to the invention, an identification system for a beverage container is provided, which system comprises a beverage container; and a plurality of discrete areas associated with said container, each area being configurable from an original condition to a visibly different condition.

In further accordance with the present invention, an identifier member for a beverage container is provided, which member comprises a member having a plurality of discrete areas each being configurable from an original condition to a visibly different condition; and means for releasably securing said member to a beverage container.

BRIEF DESCRIPTION OF THE DRAWINGS

A detailed description of preferred embodiments of the present invention follows, with reference to the attached drawings, wherein.

DETAILED DESCRIPTION

Figure 1:
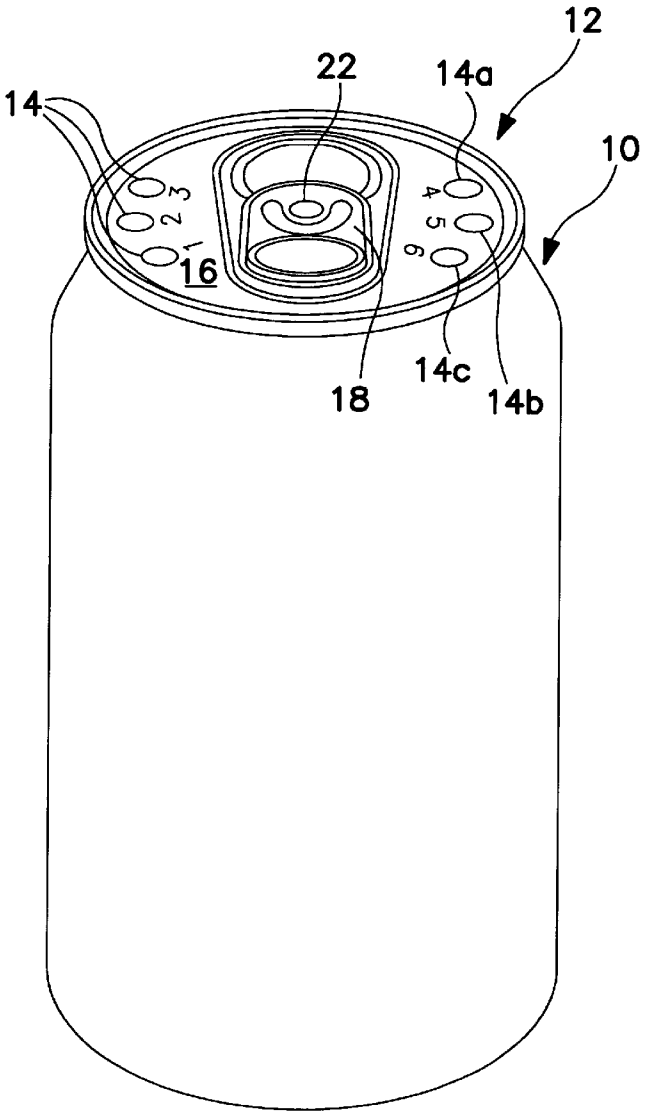
FIG. 1 is a perspective view of a beverage container including an identification system in accordance with the present invention.

FIG. 1 illustrates a perspective view of a beverage container 10 including an identification system 12 in accordance with the present invention. Identification system 12 includes a plurality of discrete areas 14, in this case positioned around the periphery of top 16 of beverage container 10, which areas 14 can be configured, for example through depression, deformation, puncturing and the like, so as to alter an original appearance to a visibly different appearance or condition.

Areas 14 are also preferably differentiable so that one area 14*a* can be distinguished from another area 14*b*, and so on. In the embodiment of FIG. 1, areas 14 are differentiable due to consecutive numeral indicia associated with each area 14.

In the embodiment of FIG. 1, areas 14 are depressible dimples which can be depressed and will retain a depressed shape, so that a user of beverage container 10 can depress one or more areas 14 so as to provide a digit or series of digits corresponding to the depressed area(s) which will serve to distinguish that beverage container 10 from the beverage containers of other people. It is noted that the provision of a plurality of areas, wherein one or more can be depressed or otherwise configured to be visibly different, advantageously provides for a potentially large number of different identifying patterns of areas. This is in stark contrast to prior art systems such as Rose '077 wherein only one identifying number can be pointed to.

Areas 14 may be formed as dimples as discussed above and as shown in FIG. 1, or may be provided as any other suitable structure which can be configured from an original condition to a visibly different condition. For example, areas 14 could be plastic blister structures which can be ruptured by a user so as to provide a visibly different condition, or a series of pull tabs or labels which may be at least partially removable. Of course, other configurations are also possible within the scope of the present invention.

In connection with areas 14 formed as deformable dimples, it is noted that, in the case of beverage containers 10 containing beverages or liquids under pressure, for example in the case of carbonated beverages, the pressure inside beverage container 10 will advantageously serve to maintain the dimples of areas 14 in an original condition against inadvertent depression, for example during shipping, stocking and the like.

Figure 2:
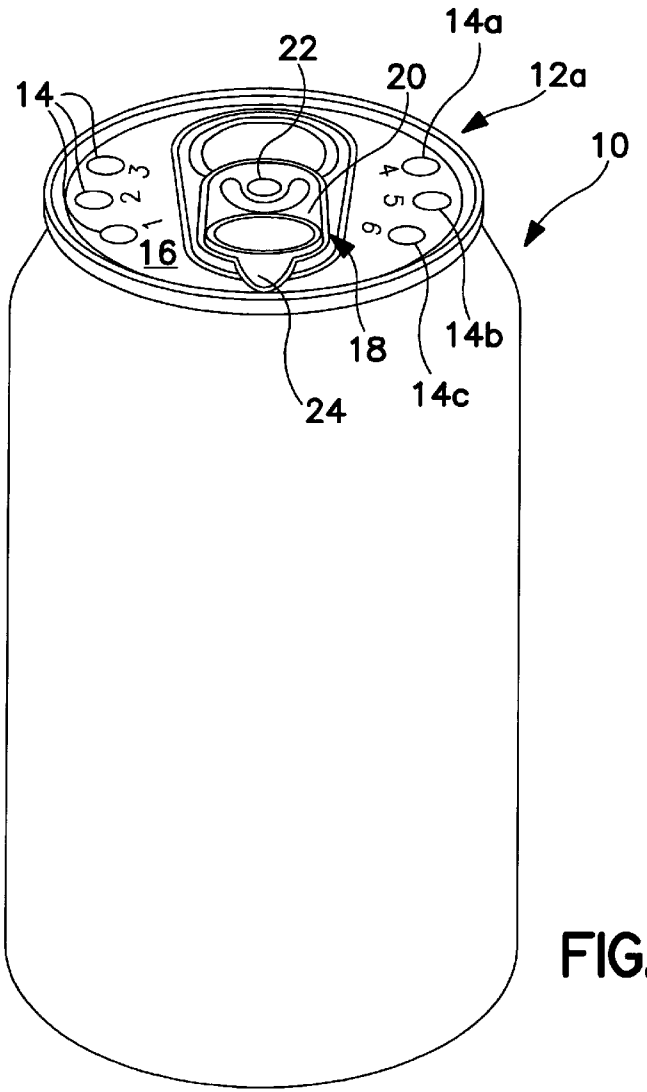
FIG. 2 is a perspective view of an alternate embodiment of a beverage container with identification system in accordance with the present invention.

FIG. 2 illustrates a perspective view of a beverage container 10 including an alternate embodiment of identification system 12*a* in accordance with the present invention. In this embodiment, system 12*a* includes areas 14 as in FIG. 1, which are disposed around top 16 as in FIG. 1. In this embodiment, pull tab 18 of container 10 is provided having a conventional body structure 20 connection to top 16 through a rivet or other member 22, and rotatable around rivet 22. In addition, body structure 20 includes an extending depression member 24 which can be rotated with body structure 20 so as to position depression member 24 in a plurality of discrete positions corresponding to areas 14. Depression member 24 can then advantageously be used in order to depress the dimples of area 14. This can be particularly advantageous in order to avoid undesirable occurrences such as breaking a finger nail and the like in the course of depressing a dimple, or area 14 particularly if it is required that dimples at areas 14 have a particular rigidity in order to maintain structural integrity of the container. System 12*a* of FIG. 2 operates in all other respects in a similar manner as the embodiment of FIG. 1.

Figure 3:
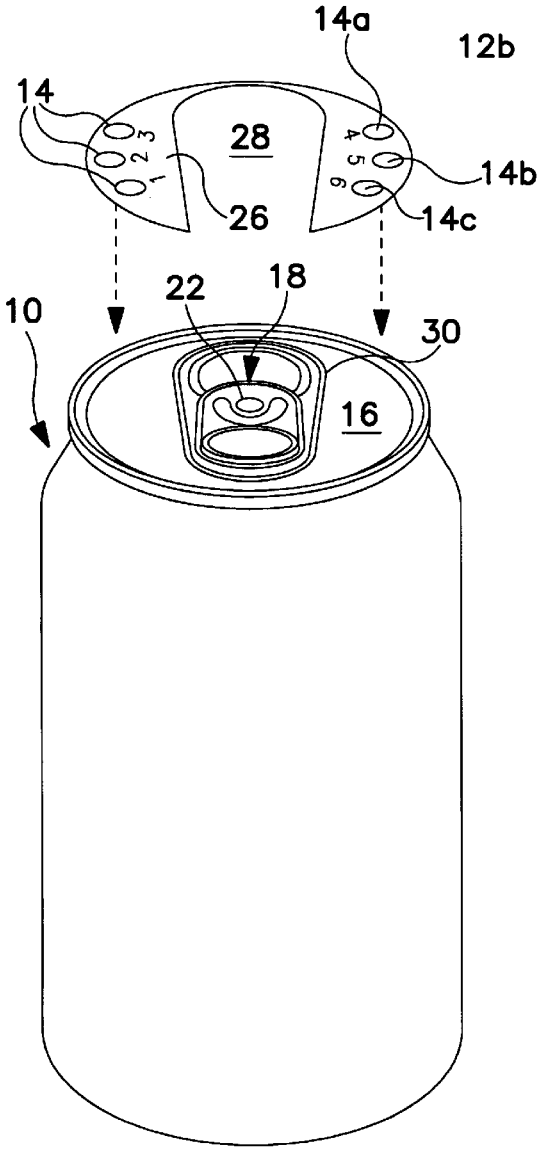
FIGS. 3, 3A are perspective and exploded views of a further alternative embodiment of a beverage container with identification system in accordance with the present invention.

Referring now to FIG. 3, a further alternative embodiment of the present invention is illustrated. In this embodiment, identification system 12*b* is disposed on a member 26 which is then mounted to beverage container 10. Member 26 may suitably be any acceptable material, for example, an additional sheet of aluminum or aluminum-containing material similar to the material from which beverage container 10 is made, or a plastic or heat shrink material, or any other material which can readily be applied to beverage container 10, for example through heat sealing, crimping, lamination and the like, and which can receive areas 14 which are sufficiently configurable from an original condition to a visibly different condition.

System 12*b* of the present invention may be desirable in various situations, for example where beverage containers 10 are available in a large supply without a system 12, 12*a* or 12*b* in accordance with the present invention, in which case system 12*b* can be provided separately for application to beverage containers 10 by consumers, if desired. Alternatively, the embodiment of system 12*b* as illustrated in FIG. 3 could also be employed during manufacturing of beverage containers 10 if particular circumstances of the manufacturing procedure render it easier to provide a separate piece bearing areas 14 which is not required for structural integrity of beverage container 10, or if it is merely easier to apply identification system 12*b* after beverage container 10 is manufactured and filled. In the embodiment shown in FIG. 3, member 26 is a generally round structure having a cutout 28 sized to fit around the opening area 30 of beverage container 10. Of course, other configurations would be possible such as members 26 which can be heat shrunk or otherwise applied to the side wall 32 of beverage container 10, or to any other portion of beverage container 10 as may be desired.

Figure 3A:
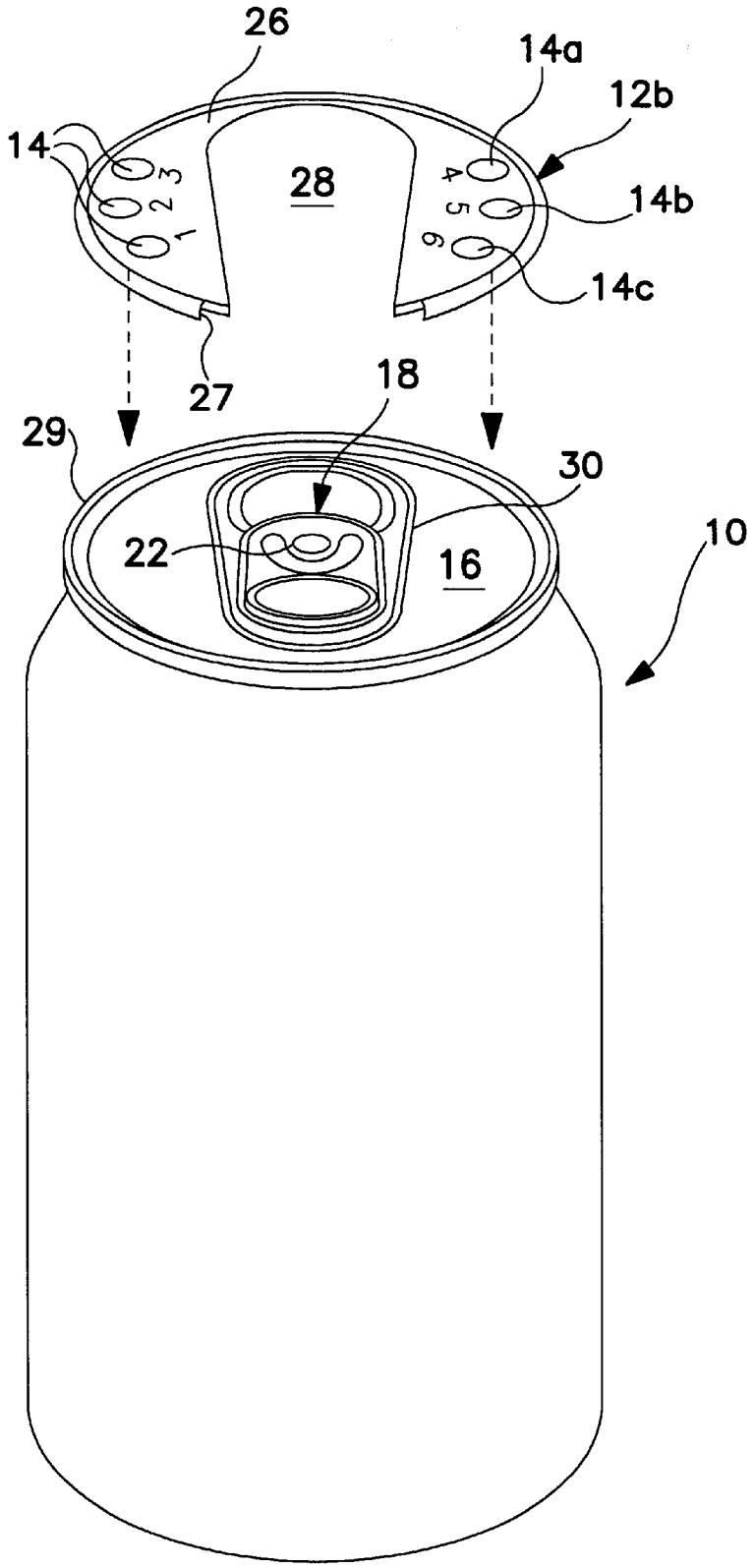

FIG. 3A shows an embodiment similar to that of FIG. 3, wherein member 26 is provided with a lip 27 adapted to snap onto a rim 29 of a standard can. This structure advantageously provides for releasably securing member 26 to container 10. This embodiment provides for identification of containers as desired in a wide variety of settings, and also for the separate sale or offering of members 26 if desirable. Of course, other methods for securing member 26 to container 10 such as straps and hook/loop fastener sections, adhesives, other types of mechanical engagement, magnetic fasteners and the like could be used.

Figure 4:
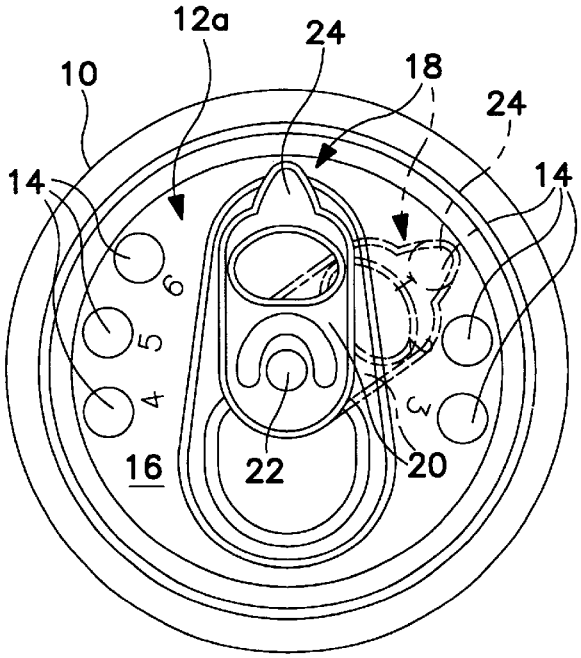
FIG. 4 is a top view illustrating operation of the embodiment of the present invention as illustrated in FIG. 2.

FIG. 4 shows a top view of the embodiment of FIG. 2 including system 12*a* having depression member 24. FIG. 4 shows depression member 24 positioned over area 14 corresponding to the numerical designation 1. In this position, depression member 24 can be depressed or otherwise pushed toward area 14 so as to depress this area and configure this area to the visibly different condition as desired. After configuration of area 14 corresponding to numeral 1, other areas could also be depressed as desired so as to assemble a particular user code or series of numbers as desired.

Figure 6:
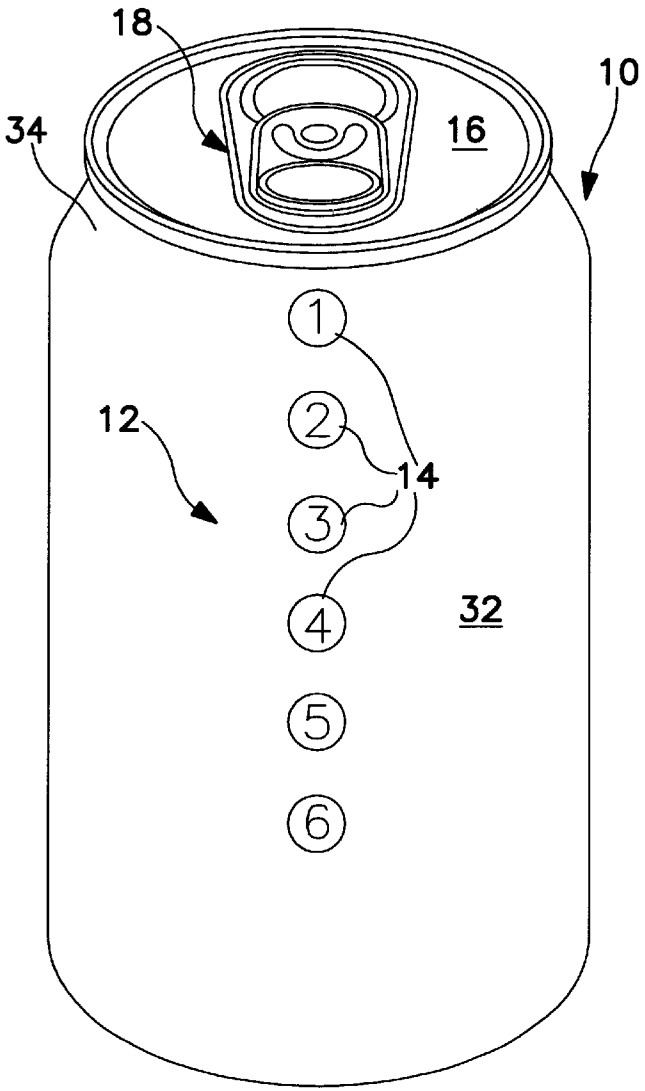
FIG. 6 is yet another alternative embodiment of the identification system of the present invention.
Figure 5:
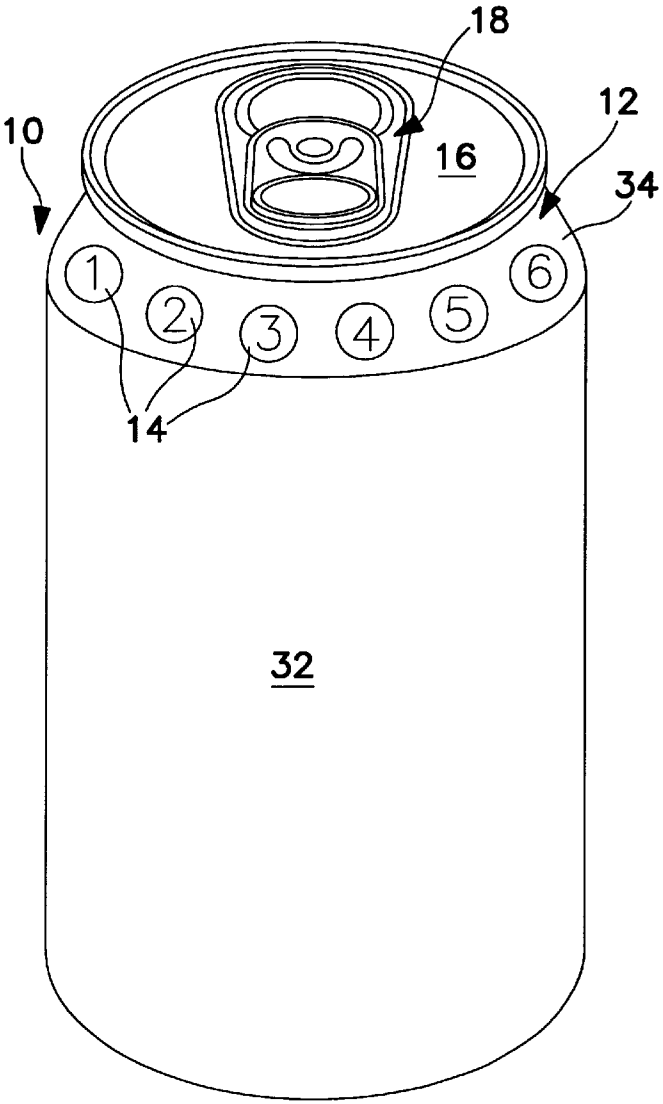
FIG. 5 is a perspective view of a still further alternative embodiment of the identification system of the present invention.

FIG. 5 illustrates a still further alternate embodiment of the present invention wherein areas 14 are positioned around side wall 32 of beverage container 10. In this configuration, areas 14 are positioned on a sloped shoulder 34 of beverage container 10, which may be desirable in certain manufacturing procedures. FIG. 6 shows a still further alternative configuration of the system of the present invention wherein areas 14 are positioned directly along side wall 32 as shown.

It should readily be appreciated that areas 14 could be provided having different indicia for differentiating purposes, for example letters, different colors or different shapes, and could also be provided having completely different structures than the dimples as discussed above.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. An identification system for a beverage container, comprising:

a beverage container;

a plurality of discrete areas associated with said container, each area being configurable from an original condition to a visibly different condition, wherein said plurality of discrete areas are depressible dimples, and wherein depressing a dimple configures said dimple to said visibly different condition; and a pull tab for opening said container, said pull tab including a depressor selectively positionable at positions corresponding to each of said plurality of discrete areas, said depressor being depressible when positioned at an area so as to configure said area to said visibly different condition.

2. A system according to claim 1, wherein said container comprises a cylindrical side wall portion and a top portion.

3. A system according to claim 2, wherein said plurality of discrete areas are formed in said top portion.

4. A system according to claim 1, wherein said plurality of discrete areas comprise a plurality of differentiable areas.

5. A system according to claim 4, wherein said plurality of differentiable areas are areas bearing different indicia.

6. A system according to claim 4, wherein said plurality of differentiable areas are areas each having a different shape.

7. A system according to claim 1, wherein said pull tab is pivotably mounted to said container and pivotable between an opening position for opening said container and said positions corresponding to said plurality of discrete areas.

* * * * *